US008042313B2

(12) United States Patent
Elliott et al.

(10) Patent No.: US 8,042,313 B2
(45) Date of Patent: Oct. 25, 2011

(54) COMPRESSION POST FOR STRUCTURAL SHEAR WALL

(75) Inventors: A. Carleton Elliott, Newport Beach, CA (US); Allan J. Swartz, Gardnerville, NV (US); Gregory Kulpa, Tustin, CA (US)

(73) Assignee: Specialty Hardware L.P., Newport Beach, CA (US)

( * ) Notice: Subject to any disclaimer, the term of this patent is extended or adjusted under 35 U.S.C. 154(b) by 0 days.

(21) Appl. No.: 12/889,165

(22) Filed: Sep. 23, 2010

(65) Prior Publication Data

US 2011/0011030 A1 Jan. 20, 2011

Related U.S. Application Data

(62) Division of application No. 12/762,361, filed on Apr. 18, 2010, now Pat. No. 7,810,290, which is a division of application No. 10/773,757, filed on Feb. 6, 2004.

(60) Provisional application No. 60/515,150, filed on Oct. 27, 2003.

(51) Int. Cl.
*E04B 1/00* (2006.01)

(52) U.S. Cl. ..... 52/741.13; 52/293.3; 52/295; 52/296; 52/298; 52/125.5

(58) Field of Classification Search ..... 52/293.1, 52/295–298, 704–706, 122.1, 125.5, 266, 52/162.12, 354.3, 170, 169.9, 293.3, 354, 52/741.13

See application file for complete search history.

(56) References Cited

U.S. PATENT DOCUMENTS

| | | | |
|---|---|---|---|
| 2,625,815 | A | 1/1953 | Black |
| 3,282,001 | A | 11/1966 | Bigelow |
| 3,552,698 | A | 1/1971 | Kinney |
| 3,633,862 | A | 1/1972 | Breen |
| 3,713,259 | A | 1/1973 | Tkach |
| 3,963,210 | A | 6/1976 | Macklin |

(Continued)

OTHER PUBLICATIONS

Young, Lee W. (Authorized Officer of PCT/ISA/US), PCT Notification of Transmittal of the International Search Report and the Written Opinion of the International Searching Authority; PCT International Search Report; and PCT Written Opinion of the International Searching Authority, mailed on Aug. 1, 2008, in International Application No. PCT/US07/80074, 9 pages total.

*Primary Examiner* — Eileen D Lillis
*Assistant Examiner* — Chi Nguyen
(74) *Attorney, Agent, or Firm* — Jerry Turner Sewell

(57) ABSTRACT

A compression post for a shear wall includes a plate mounted to the bottom of an end post of a shear wall. The plate is sized to conform to the lower end of each end post. An extended portion (e.g., a cylinder) is positioned perpendicularly to the plate. The extended portion has a cross section sized to fit through a hole in a mudsill of the shear wall and has a length selected to conform with a thickness of the mudsill. When the shear wall is mounted on a structural support (e.g., a footing or foundation), forces applied to the end post pass through the plate and the extended portion to the structural support. The extended portion may be secured to the plate (e.g., by spot welding, press fitting, bolting, or threaded engagement) or the two portions may be independent. The two portions may also be a cast unitary body.

10 Claims, 8 Drawing Sheets

U.S. PATENT DOCUMENTS

| | | | | | |
|---|---|---|---|---|---|
| 4,240,766 | A | | 12/1980 | Smith et al. | |
| 4,321,776 | A | | 3/1982 | Delight | |
| 4,412,407 | A | | 11/1983 | Melfi et al. | |
| 4,480,819 | A | | 11/1984 | Lopez | |
| 4,830,341 | A | | 5/1989 | Arteau et al. | |
| 5,249,404 | A | | 10/1993 | Leek et al. | |
| 5,257,489 | A | | 11/1993 | Angelette et al. | |
| 5,266,738 | A | | 11/1993 | MacVoy | |
| 5,375,384 | A | | 12/1994 | Wolfson et al. | |
| 5,568,909 | A | * | 10/1996 | Timko | 248/519 |
| 5,603,187 | A | | 2/1997 | Merrin et al. | |
| 5,765,333 | A | | 6/1998 | Cunningham | |
| 5,768,841 | A | | 6/1998 | Swartz et al. | |
| 5,862,635 | A | | 1/1999 | Linse et al. | |
| 6,015,138 | A | | 1/2000 | Kohlberger et al. | |
| 6,015,139 | A | | 1/2000 | Weber | |
| 6,050,033 | A | | 4/2000 | Wrightman | |
| 6,112,495 | A | | 9/2000 | Gregg et al. | |
| 6,158,188 | A | | 12/2000 | Shahnazarian | |
| 6,308,469 | B1 | | 10/2001 | Leung | |
| 6,327,831 | B1 | | 12/2001 | Leek | |
| 6,389,767 | B1 | | 5/2002 | Lucey et al. | |
| 6,453,634 | B1 | * | 9/2002 | Pryor | 52/713 |
| 6,513,290 | B2 | * | 2/2003 | Leek | 52/295 |
| 6,564,519 | B2 | | 5/2003 | Lucey et al. | |
| 6,643,986 | B2 | | 11/2003 | Commins et al. | |
| 6,685,154 | B1 | | 2/2004 | Blyth et al. | |
| 6,745,529 | B2 | | 6/2004 | Beltran | |
| 7,195,222 | B2 | * | 3/2007 | Dent | 248/511 |
| 7,513,083 | B2 | | 4/2009 | Pryor et al. | |
| D602,175 | S | | 10/2009 | Droomer | |
| 7,810,290 | B2 | * | 10/2010 | Elliott et al. | 52/293.3 |
| 2001/0002529 | A1 | * | 6/2001 | Commins et al. | 52/481.1 |

* cited by examiner

COMPRESSION POST FOR STRUCTURAL SHEAR WALL

RELATED APPLICATIONS

The present application is a divisional application of U.S. patent application Ser. No. 12/762,361 filed on Apr. 18, 2010, which is issuing as U.S. Pat. No. 7,810,290. U.S. patent application Ser. No. 12/762,361 is a divisional application of U.S. patent application Ser. No. 10/773,757 filed on Feb. 6, 2004, which is pending. U.S. patent application Ser. No. 12/762,361 claims the benefit of priority under 35 U.S.C. §119(e) to U.S. Provisional Application No. 60/515,150 filed on Oct. 27, 2003.

BACKGROUND OF THE INVENTION

1. Field of the Invention

The present invention is in the field of elements for use in construction, and, more particularly, is in the field of construction elements for reducing damage caused to structures during seismic events, severe wind events and other forces applied to structures.

2. Description of the Related Art

During a seismic event, such as an earthquake, or during a severe wind event, a structure may be subjected to large forces which can result in severe damage or total destruction of the structure. Conventional walls of a residential structure comprise a lower mudsill that rests on a concrete footing or other suitable foundation. An upper double top plate is spaced apart from the mudsill with a plurality of vertical studs which are generally evenly spaced (e.g., sixteen inches or twenty-four inches on center ("o/c")). The outer portion of a conventional wall is sheathed with plaster, siding or other suitable material, and the inner portion is covered with gypsum board, paneling or the like. Such a conventional wall cannot withstand the forces of seismic event or severe wind event because the shape of the wall distorts when the upper portion of the conventional wall moves laterally with respect to the mudsill. Even if the structure withstands the seismic event, the lateral movement of the wall causes cracks, broken windows and the like. In many cases, the wall does not return to its original shape after the seismic event or wind event is over.

In order to reduce the likelihood of structural damage during a seismic event or wind event, many residential structures are now constructed with shear walls. In particular, at least a portion of each of the inner and outer walls comprises a shear wall. A shear wall may comprise a specially constructed section of any wall which is constructed at a building site. Alternatively a shear wall may comprise a panel constructed separately and inserted into any wall at the building site. Both types of shear walls are included within the scope of the following description.

Unlike a conventional wall, a shear wall includes a solid structural sheet positioned over the outer surface or the inner surface. The solid structural panel of the shear wall may advantageously comprise one or more plywood sheets of suitable thickness. Alternatively, the shear wall may comprise a laminated panel of steel or another metallic material. See, for example, U.S. Pat. No. 5,768,841 to Swartz et al. for Wallboard Structure. Each end of the shear wall comprises a larger vertical member (e.g., an end post) to which the solid structural sheet is also attached. For example, the end posts may advantageously comprise a conventional 4×4 or larger post. During seismic events or severe wind events, the forces applied to the shear wall are coupled to the foundation via the end posts. Furthermore, the end posts are secured to the foundation via hold down devices, such as, for example, the hold down connector shown in U.S. Pat. No. 5,249,404 to Leek et al. for Holdown Structure.

The solid structural sheet of the shear wall inhibits the movement of the upper double top plate with respect to the mudsill when force is applied. Thus, the shear wall does not distort. By tying the remaining portion of any wall to the shear wall, movement of the entire wall is inhibited, and damage caused by the force is substantially reduced.

Although shear walls reduce the damage during seismic events, studies have shown that during very large seismic events or severe wind events, the forces applied to the shear wall and coupled to the end posts are sufficiently large to cause the lower ends of the end posts to compress the mudsill. The wood fibers in the compressed mudsill are crushed to reduce the thickness of the mudsill. The reduced thickness of the mudsill allows more movement of the shear wall, and thus may result in severe damage or destruction of the structure.

Because of the compression of the mudsill, building codes have been revised recently to require the mudsill of the shear wall to be constructed from larger material. For example, instead of allowing a contractor to use a conventional 2×4 or 2×6 material having a nominal thickness of 1.5 inches, the contractor is required to use a 3×4 or 3×6 mudsill having a nominal thickness of 2.5 inches to substantially reduce compression of the mudsill of the shear wall.

The additional thickness of the mudsill would appear to be a relatively straightforward way of reducing damage caused by seismic events and severe wind events; however, the thicker mudsill causes additional construction expenses for a contractor. For example, three-inch thick lumber is non-conventional. Thus, a contractor has to special order 3×4 or 3×6 lumber to construct the mudsill or create the mudsill at the construction site from larger material. In addition, the conventional studs between the mudsill and the double top plate have to be cut to be one inch shorter than conventional studs. Although this might appear to be a minor inconvenience, it should be understood that hundreds or thousands of studs are used at a large number of construction sites (e.g., at a new housing development or a new apartment complex). The additional time required to cut each stud rather than using the studs as delivered from the lumber supplier adds substantial cost and waste to a large construction project. Furthermore, since the required thickness of the 3×4 or 3×6 mudsill is 2.5 inches thick, the carpenters building walls with such mudsills must use larger nails to connect the mudsill to the bottoms of the studs. The larger nails are more expensive. In addition, the larger nails do not work with conventional nail guns. Since the economies of modern construction depend on the use of nail guns as well as other power tools to reduce construction time, the loss of the use of the nail gun for such repetitive work has a significant economic impact on the profit of the contractor or the cost to the owner of the finished structure. Thus, an alternative to the thicker mudsill is needed.

SUMMARY OF THE INVENTION

One aspect of the present invention is a construction element to inhibit compression of a mudsill by the end posts of a shear wall and thereby eliminate the requirement for a thicker mudsill. The construction element is referred to herein as a compression post. The compression post comprises steel or other suitable material mounted to the lower end of an end post of a shear wall. The compression post comprises a plate that attaches the compression post to the lower end of the end post. The compression post further comprises an extended portion (e.g., a cylinder) positioned generally perpendicularly to the plate. The extended portion has a length selected to be at least as great as the thickness of the mudsill such that a free end of the extended portion rests on the structural support (e.g., a footing or foundation) beneath the mudsill. The extended portion is sized to pass through a hole in the mudsill. When the shear wall is mounted on the structural support, the free end of the extended portion rests on the structural support. Forces applied to the end post during a seismic event or during a severe wind event are communicated from the end post to the structural support via the compression post such that the mudsill experiences substantially no compression during the event.

Another aspect in accordance with embodiments of the present invention is a shear wall mountable on a structural support such as a footing or a foundation. The shear wall has a first end, a second end, a bottom and a top. The shear wall comprises a mudsill at the bottom of the shear wall, a double top plate at the top of the shear wall, a plurality of studs positioned between the mudsill and the double top plate, a first end post at the first end of the shear wall, and a second end post at the second end of the shear wall. The first end post and the second end post have respective lower ends. A structural sheet is mounted to the mudsill, the double top plate, the studs, the first end post and the second end post to form a rigid structure. The shear wall further comprises a first compression post positioned at the lower end of the first end post and a second compression post positioned at the lower end of the second end post. Each compression post comprises a plate mounted to the respective lower end of the respective end post. The plate has dimensions selected to conform to the lower end of the end post. Each compression post further comprises an extended portion positioned perpendicularly to the plate. The extended portion has at least one dimension selected so that the extended portion fits through a hole in the mudsill. The extended portion has a length selected to conform to a thickness of the mudsill. When the shear wall is mounted on the structural support, forces applied to the end post are communicated via the plate and the cylinder to the structural support.

Another aspect in accordance with embodiments of the present invention is a method of reducing the lateral movement of a shear wall during a seismic event or a wind event. The method comprises constructing a shear wall having a first end post and a second end post mounted between a mudsill and a double top plate. The method further comprises positioning a respective compression post on a lower end of each end post. The compression post has an extended portion that passes through a hole in the mudsill. The method further comprises positioning the shear wall on a structural support (e.g., a footing or a foundation) with respective exposed ends of the extended portions of the compression posts resting on the structural support. Forces applied to the end posts are communicated to the structural support via the compression posts rather than via the mudsills.

BRIEF DESCRIPTION OF THE DRAWINGS

The foregoing aspects and other aspects of this disclosure are described in detail below in connection with the accompanying drawing figures in which.

DETAILED DESCRIPTION OF PREFERRED EMBODIMENTS

Figure 1:
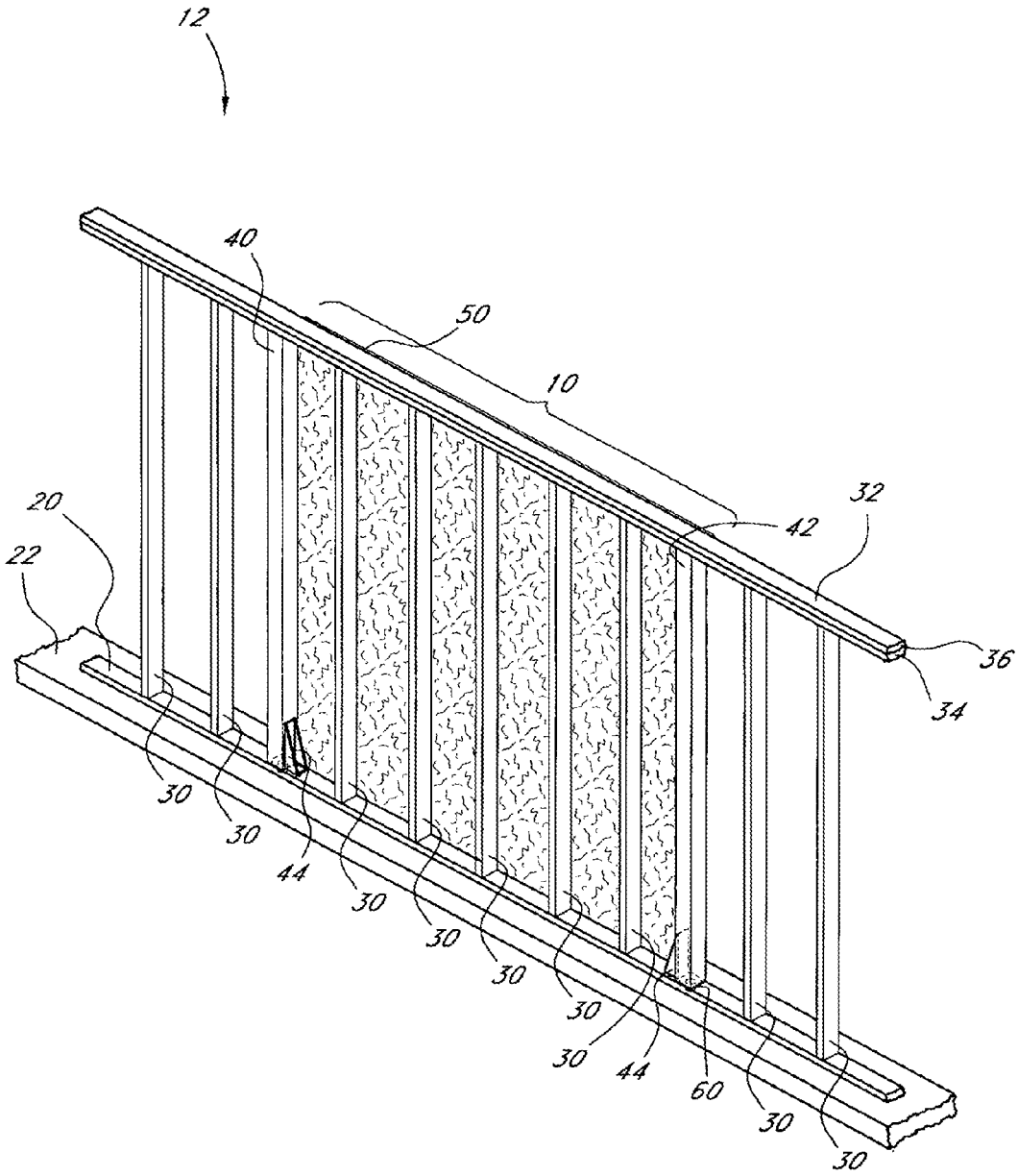
FIG. 1 illustrates a perspective view of a shear wall incorporating a compression post in accordance with an embodiment of the present invention.

FIG. 1 illustrates an exemplary shear wall 10 into which embodiments in accordance with the present invention can be incorporated. In FIG. 1, the shear wall 10 comprises a section of a wall 12 of a structure (not shown). A lower portion of the shear wall 10 comprises a mudsill 20, which extends beyond the shear wall 10 and which advantageously forms a common lower portion of the wall 12 such that the conventional wall construction is also mounted on the mudsill 20. The mudsill 20 is mounted on a footing 22, which may also be referred to as the foundation of the structure.

A plurality of studs 30 have their respective lower ends mounted to the mudsill 20 before the wall 12, including the shear wall 10, is erected and placed on the footing 22. For example, the studs 30 are connected to the mudsill 20 via nails (not shown) driven through the bottom of the mudsill 20 and into the lower ends of the studs 30. A double top plate 32 is mounted to respective upper ends of the studs 30. One skilled in the art will appreciate that the double top plate 32 conventionally comprises a first top plate portion 34 nailed directly to the upper ends of the studs 30 and a second top plate portion 36 nailed to the first top plate portion 34.

The shear wall 10 further includes a first end post 40 and a second end post 42. The end posts 40, 42 are spaced apart by a distance selected to provide an overall length for the shear wall 10. The length may be selected, for example, to conform with building codes applicable to the location of the construction site. Preferably, respective hold down connectors 44 are attached to the end posts 40, 42 a plurality of bolts and nuts (not shown). The hold down connectors 44 engage bolts (not shown) embedded in the footing 22 and are secured by nuts (not shown) so that the end posts 40, 42 cannot lift from the footing 22 during a seismic event or a severe wind event. Exemplary hold down connectors and the associated nuts and bolts are disclosed, for example, in U.S. Pat. No. 5,249,404, the disclosure of which is incorporated by reference herein.

A structural sheet 50 is mounted on the shear wall using nails or other fasteners (not shown) to connect the structural sheet 50 to the end posts 40, 42, the studs 30, the mudsill 20 and the double top plate 32. The thickness of the structural sheet 50, the number of nails, and the spacing of the nails are determined by the applicable building code. After the structural sheet 50 is fastened to the other elements of the shear wall 10, the shear wall 10 comprises a substantially rigid structure that inhibits lateral movement of the shear wall 10 in response to forces caused by seismic events and wind events. Since the shear wall 10 is coupled to the wall 12, the inhibition of movement by the shear wall 10 causes movement of the wall 12 to be inhibited. By inhibiting the movement of the shear wall 10, the wall 12 is protected from large movements during the events. As discussed above, the structural sheet may comprise one or more sheets of plywood, or, the structural sheet may comprise a laminated panel of steel or another metallic material, as described, for example, in U.S. Pat. No. 5,768,841, the disclosure of which is incorporated by reference herein.

Figure 3:
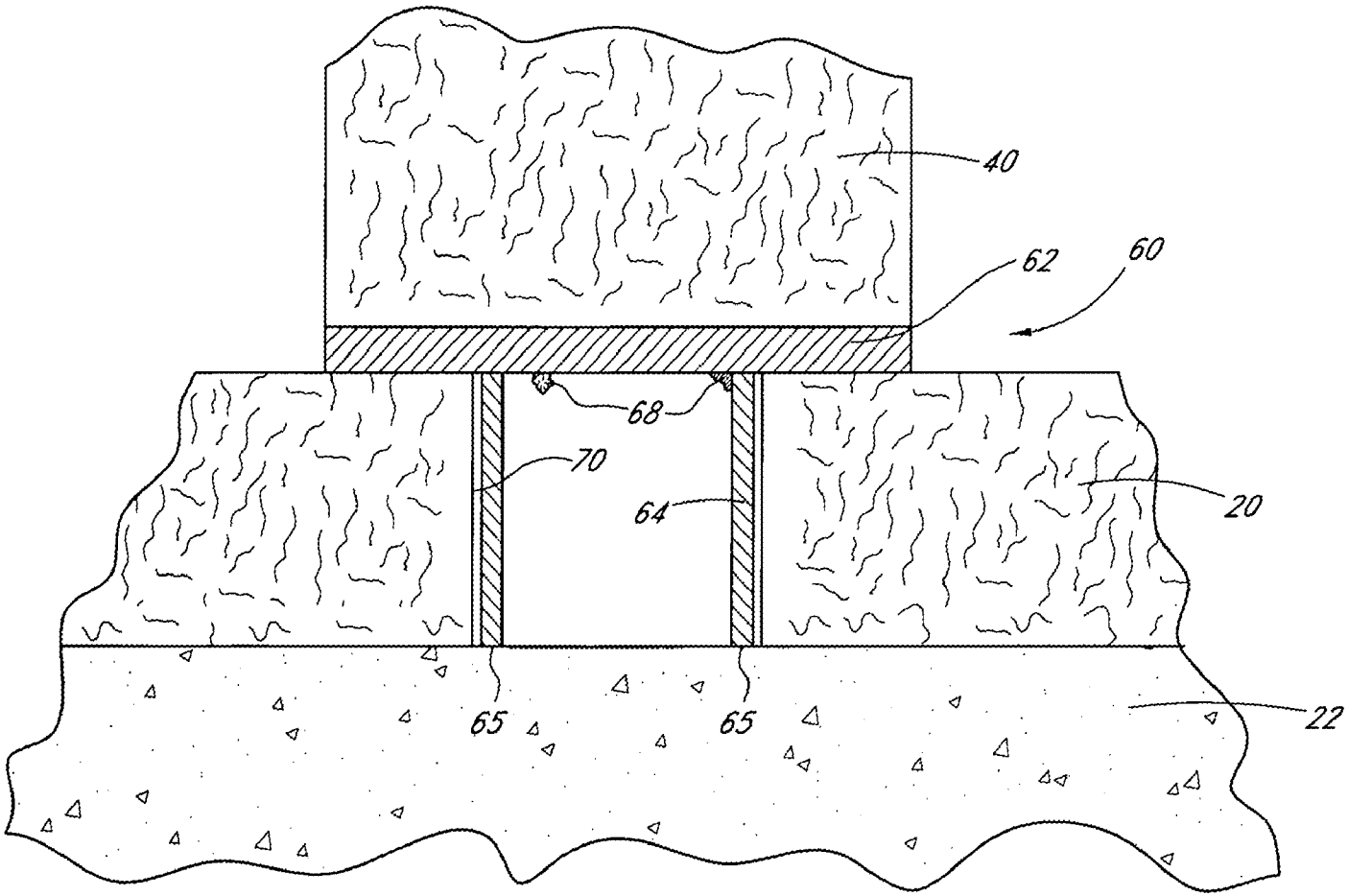
FIG. 3 illustrates a cross-sectional elevational view of the compression post mounted on the bottom of an end post with the extended portion of the compression post inserted through a hole in a mudsill, wherein the extended portion is spot-welded to the plate.

As discussed above, the mudsill 20 is conventionally constructed from 2×4 or 2×6 lumber having a nominal thickness of 1.5 inches thick. The building codes in California, for example, were recently revised to require the mudsill 20 to be constructed from 3×4 or 3×6 lumber having a nominal thickness of 2.5 inches thick in order to inhibit compression and crushing of the mudsill 20. The present invention may allow conventional 2×4 or 2×6 lumber to continue to be used. In particular, as shown in FIG. 3 for the end post 40, the lower end of each end post 40, 42 has a compression post 60 mounted thereon.

Figure 2:
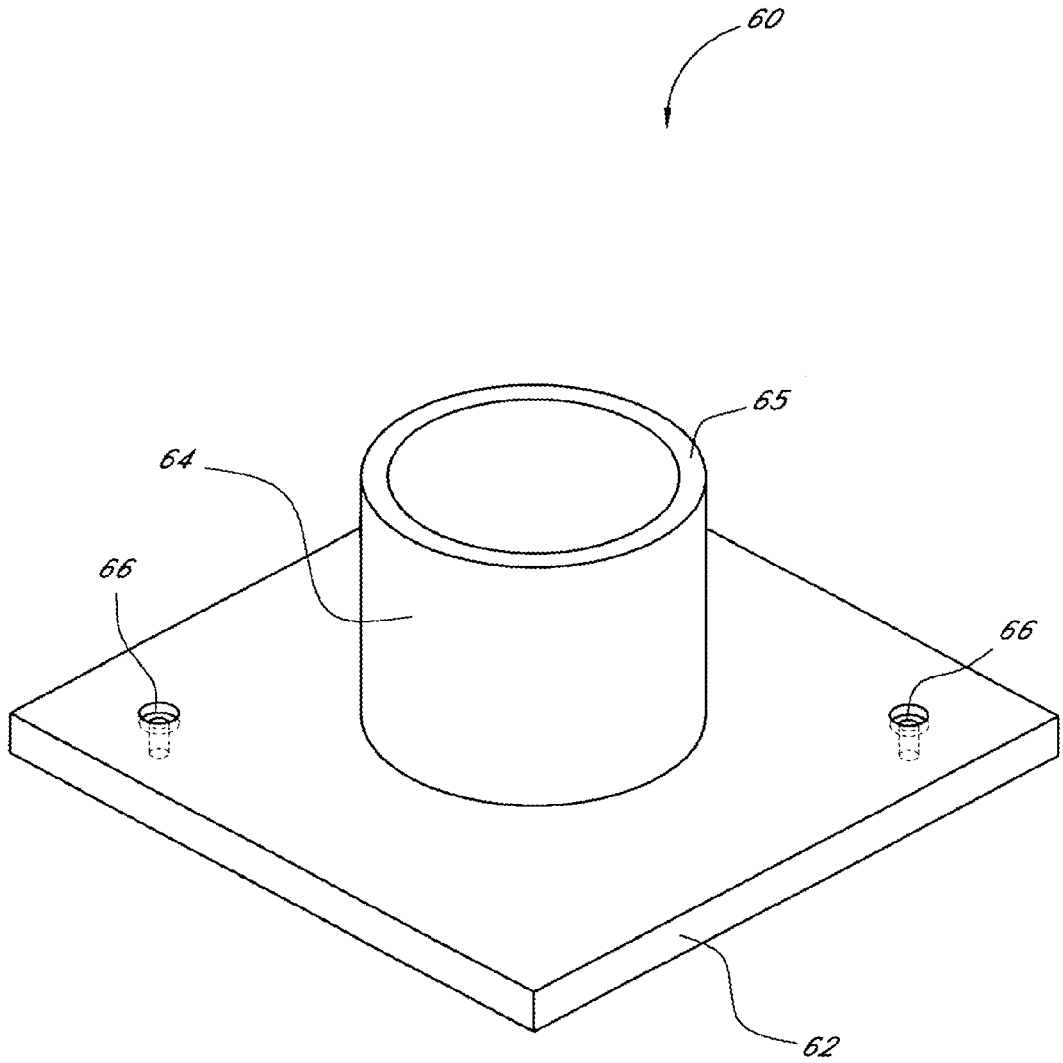
FIG. 2 illustrates a perspective view of an embodiment of the compression post having a generally rectangular plate and a cylindrical extended portion.

As shown in FIG. 2, the compression post 60 comprises a steel plate 62 and a steel extended portion 64 that is oriented substantially perpendicular to the plane of the plate 62. Preferably, the plate 62 has a generally rectangular shape selected to conform with the lower ends of the end posts 40, 42. For example, for a 4×4 compression post, the plate 62 advantageously is shaped as a square having dimensions of approximately 3.5 inches by 3.5 inches to conform with the nominal dimensions of 4×4 lumber. If larger posts are used or if posts that are not square (e.g., 4×6 posts) are used, the size and shape of the plate 62 is advantageously selected accordingly. In advantageous embodiment, the plate 62 has a thickness of approximately 0.25 inch. The plate 62 advantageously includes a pair of holes 66 through which screws, nails or other fasteners can be inserted to engage the bottom of the end post 40, 42 to secure the compression post 60 to the end post 40, 42.

In the illustrated embodiment, the extended portion 64 is cylindrical and advantageously comprises a steel tube having an outer diameter of approximately 1.625 inches and an inner diameter of 1.25 inches such that the walls of the cylinder are approximately 0.1875 (three-eighths) inch thick. In the embodiment illustrated in FIG. 3, one end of the cylindrical extended portion 64 is welded to the plate 62 such that the extended portion 64 is mounted perpendicularly to the plate 62. Preferably, the inner circumference of the cylinder 64 is welded to the plate 62 by a plurality of spot welds 68 such that the outer surface of the cylinder 64 does not have any welding fillets and thus remains substantially round. The opposite end of the cylinder 64 is a free end 65. Although illustrated herein as being hollow, the cylinder 64 can also advantageously comprise a solid material (e.g., a steel rod). The outer diameter of the cylinder 64 and the thickness of the cylinder wall (when a hollow cylinder is used) can be selected according to strength requirements established by an engineer of record for a construction project.

Although the extended portion 64 is illustrated herein as a cylinder having a circular cross section, one skilled in the art will appreciate that the extended portion 64 may have other shapes. For example, the extended portion 64 may advantageously have a rectangular shape. For 4×4 end posts 40, 42 and other end posts having a square cross section, the rectangular extended portion 64 may have a square cross section. For non-square end posts 40, 42 (e.g., 4×6 end posts), the rectangular extended portion 64 may have sides with dimensions proportional to the dimensions of the end posts 40, 42.

Although the extended portion 64 may have alternative shapes, for convenience in describing the illustrated embodiment, the extended portion 64 is referred to below as the cylinder 64.

The length of the cylinder 64 is selected to be approximately 1.5 inches thick. In particular, as shown in FIG. 3, the length of the cylinder 64 is selected to conform to the thickness of the mudsill 20 such that when the cylinder 64 is inserted in a hole 70 in the mudsill 20, the plate 62 rests on top of the mudsill 20 and the free end 65 of the cylinder 64 rests on the footing 22. Thus, the weight of the end post 42 is communicated directly to the footing 22 via the compression post 60 rather than being applied to the mudsill 20. More importantly, when the forces caused by a seismic event or a severe wind event are applied to the end post 40 (or the end post 42), the forces are transmitted directly to the footing 22 without compressing the mudsill 20. Thus, the fibers of the mudsill 20 are not crushed by the end post 40, and the additional movement that would have been allowed by the crushed mudsill 20 does not occur. By reducing the movement in this manner, the damage to the structure that would have otherwise occurred is reduced or eliminated. Furthermore, the compression post 60 permits the use of a conventional mudsill and conventional studs so that the benefits of reduced seismic and wind damage are obtained without a significant increase in construction costs.

Preferably, the diameter of the hole 70 formed in the mudsill 20 is selected to be slightly larger than the outer diameter of the cylinder 64 so that the cylinder 64 can be easily inserted into the hole 70 during construction while limiting the lateral movement of the cylinder 64 within the hole 70. In preferred embodiments, the diameter of the hole 70 is selected to be approximately 0.0625 inch (1/16 inch) larger than the outer diameter of the cylinder 64. For example, in the illustrated embodiment, the hole 70 has a diameter of approximately 1.6875 inches (1 11/16 inches) to accommodate a cylinder 64 having a diameter of 1.625 inches (1 5/8 inches).

Although described herein with respect to a 1.5-inch thick mudsill 20, a longer cylinder 64 can be used with thicker mudsills in jurisdictions which continue to require the thicker mudsill. Even with a thicker mudsill, compression will occur using conventional construction, and the compression post 60 reduces the compression.

Figure 4:
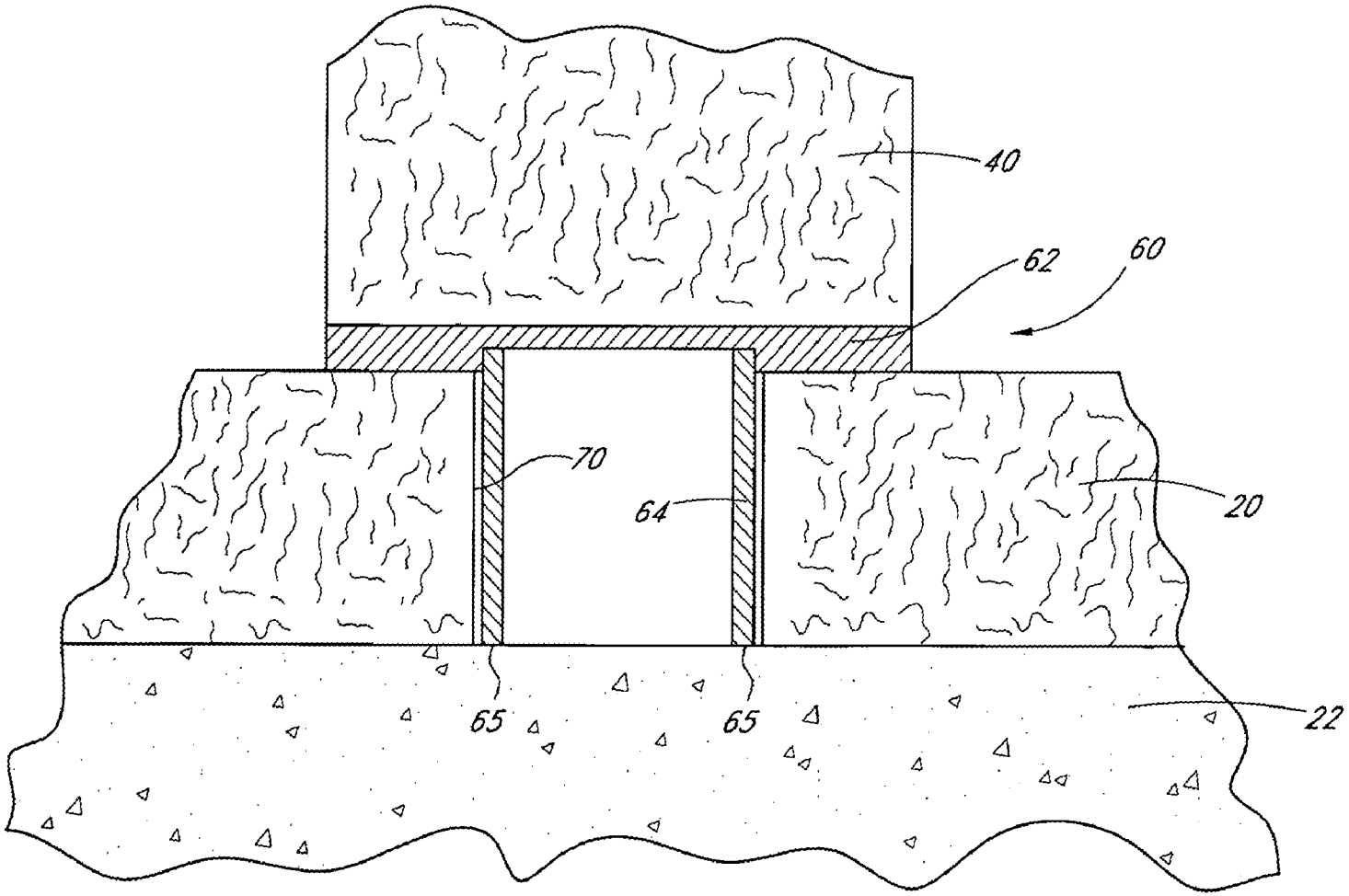
FIG. 4 illustrates a cross-sectional elevational view of an alternative embodiment of the compression post with the extended portion inserted through a hole in a mudsill, wherein the extended portion is press-fit into the plate portion.

In an alternative embodiment illustrated in FIG. 4, the cylinder 64 may be press fit into a suitably sized opening formed in the plate 62 so that spot welding is not needed.

Figure 5:
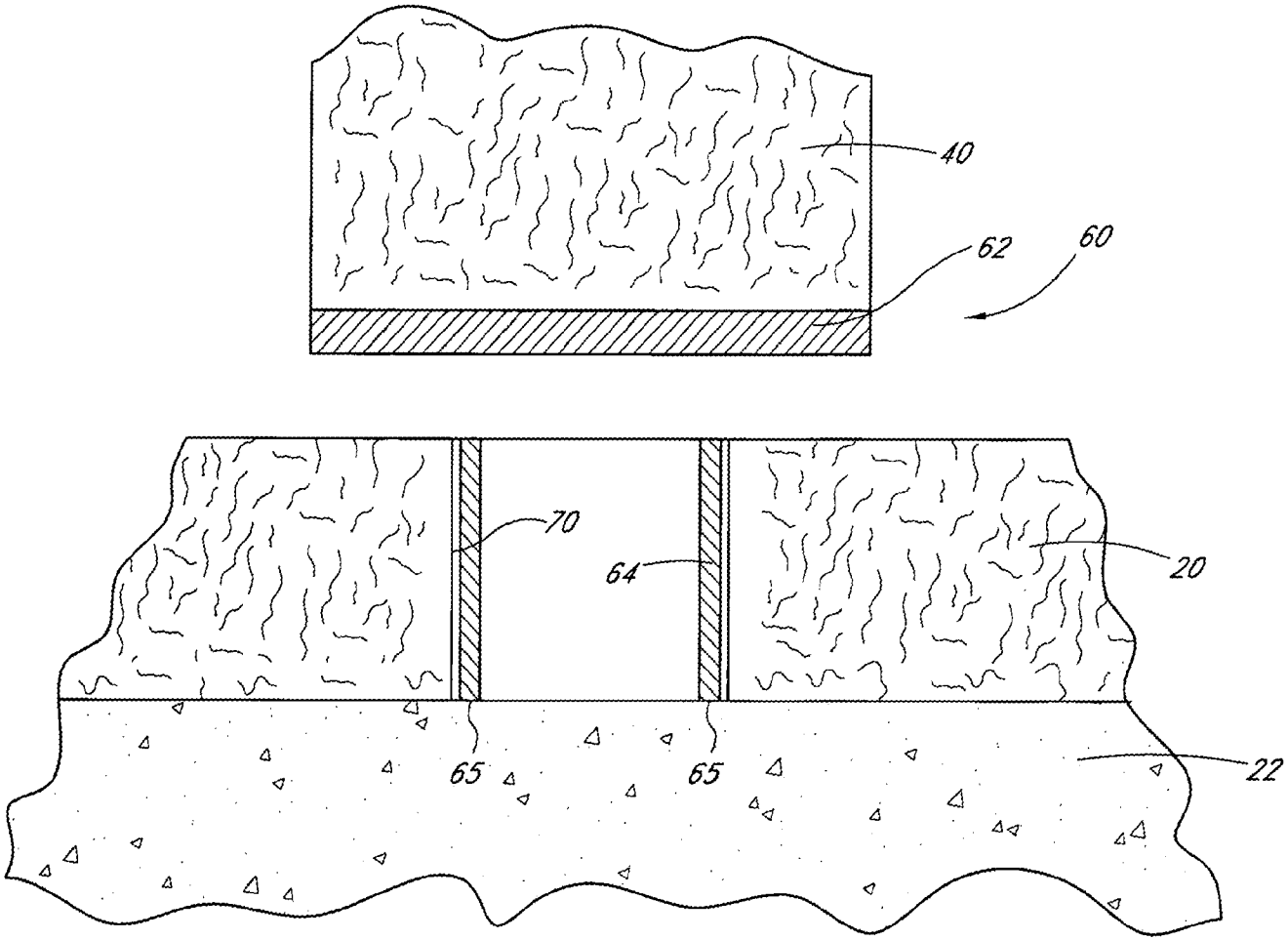
FIG. 5 illustrates a cross-sectional elevational view of an alternative embodiment of the compression post in which the plate and the extended portion are independent prior to installation of the plate and extended portion in a shear wall.

In another alternative embodiment illustrated in FIG. 5, the cylinder 64 is not fixed to the plate 62. Rather, the cylinder 64 is initially provided as an independent element. During construction of the shear wall, the cylinder 64 is positioned through each hole 70 in the mudsill 20 independently of the respective plate 62. The plates 62 are secured to the bottoms of the end posts 40, 42, as discussed above. When the end posts 40, 42 are positioned over the holes 70 in the mudsill 20, the plates 62 engage the cylinders 64 and the forces applied to the end posts 40, 42 are communicated through the cylinders 64 to the footing 22, as discussed above. In this alternative embodiment, the lengths of the cylinders 64 can be selected to accommodate the thickness of the mudsill at a particular location in the structure under construction. Thus, a plurality of sizes of plates 62 can be stocked to accommodate a variety of sizes of end posts and a plurality of lengths of cylinders 64 can be stocked to accommodate a variety of thicknesses of mudsills. A combination of plate size and cylinder length can be selected for a particular job requirement.

Figure 6:
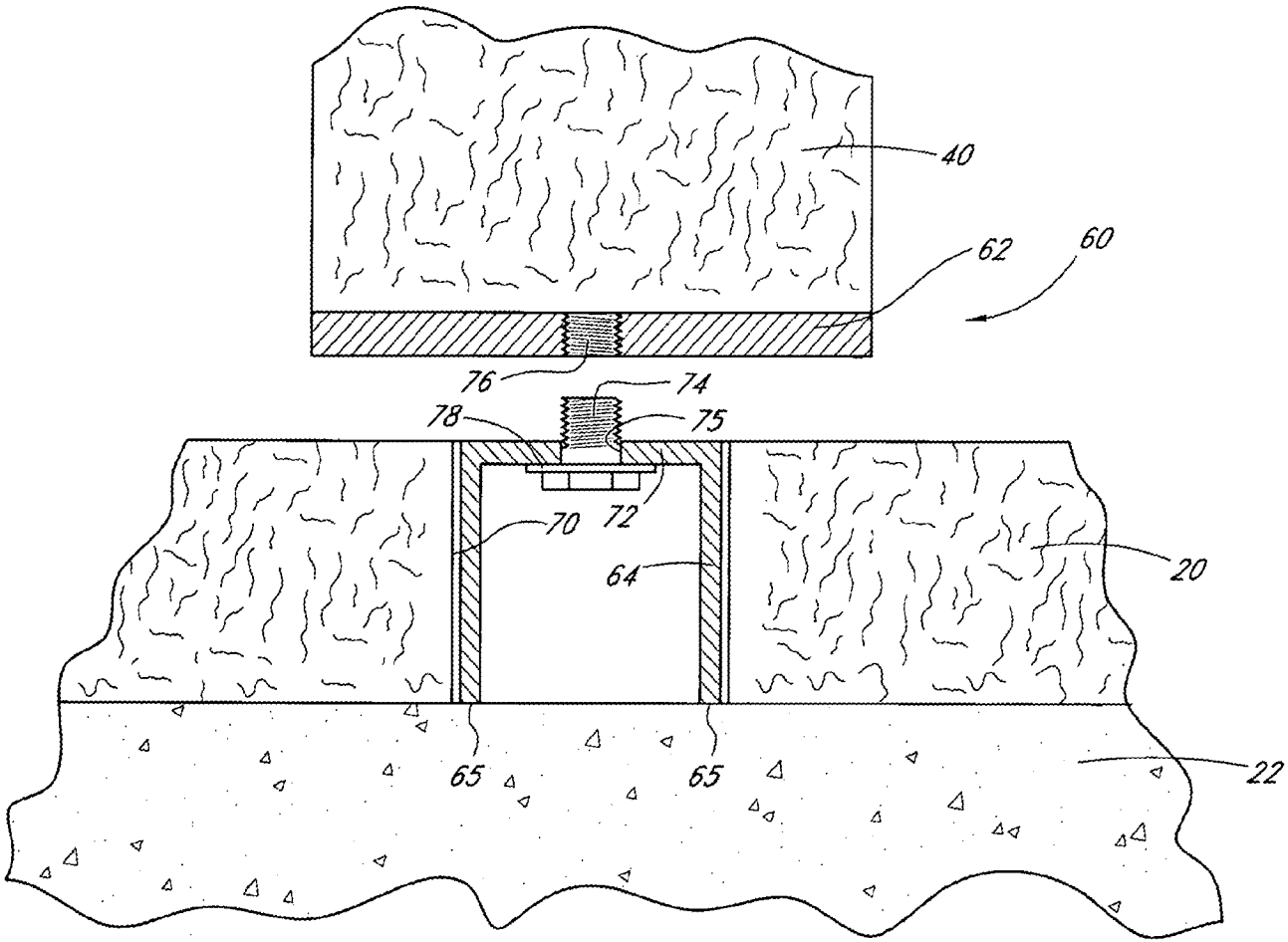
FIG. 6 illustrates a cross-sectional elevational view of an alternative embodiment of the compression post in which the extended portion is coupled to the plate by a fastening system.

In another alternative embodiment illustrated in FIG. 6, a fastening system secures the cylinder 64 to the plate 62. The cylinder 64 includes an endcap 72. A bolt 74 is inserted through a bore 75 in the endcap 72. A threaded portion of the bolt 74 engages a threaded bore 76 in the plate 62 to secure the cylinder 64 to the plate 62. A washer 78 is advantageously included between the head of the bolt 74 and the endcap 72. The washer 78 is advantageously a lock washer.

Figure 7:
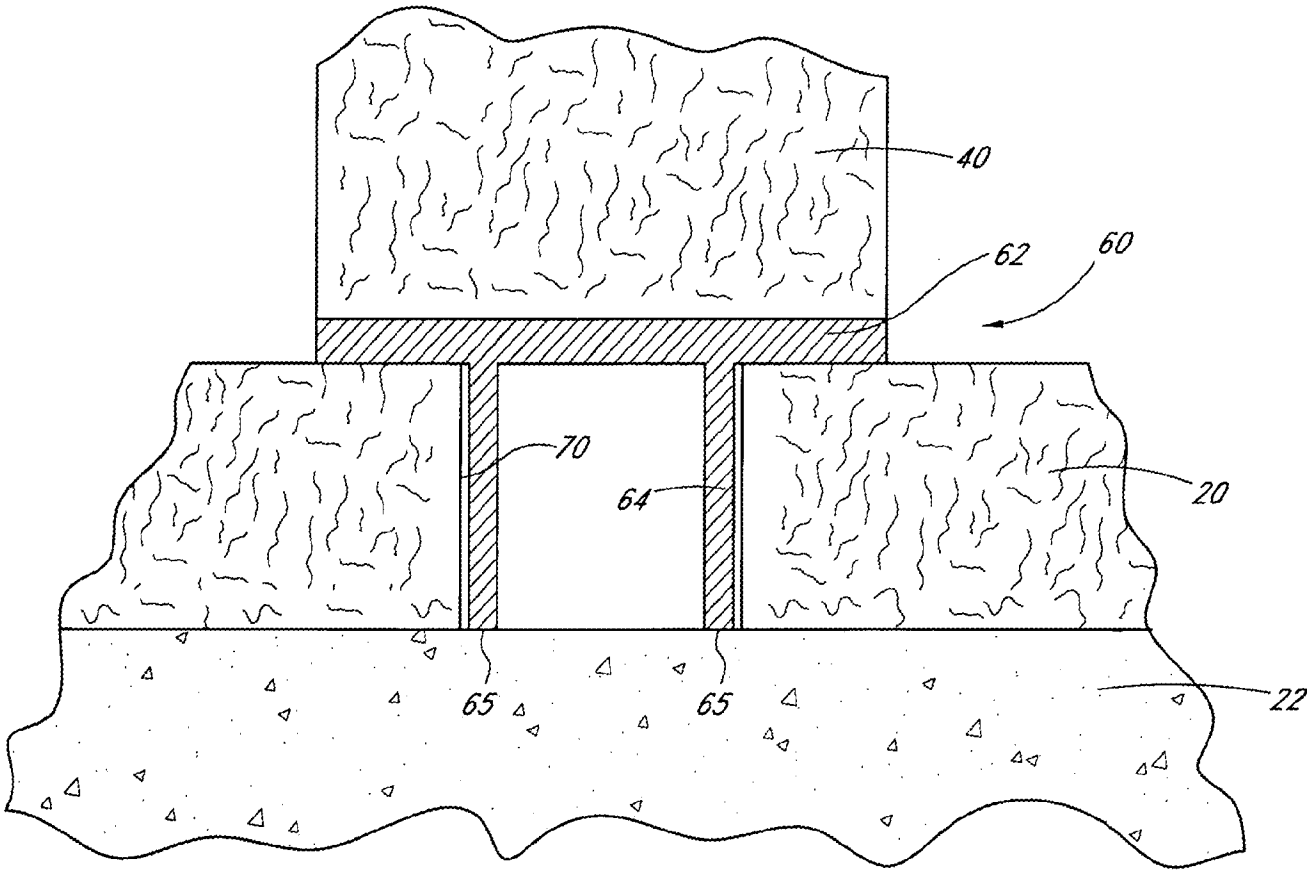
FIG. 7 illustrates a cross-sectional elevational view of an alternative embodiment of the compression post in which the extended portion and the plate are cast as a unitary body.

In another alternative embodiment illustrated in FIG. 7, the extended portion (e.g., cylinder) 64 and the plate 62 are cast as a unitary body. Although shown as a hollow cylinder 64 in FIG. 7, the extended portion 64 can also be cast as a solid body. Furthermore, as discussed above, it should be understood that the extended portion 64 can be advantageously cast in other shapes (e.g., rectangular).

Figure 8:
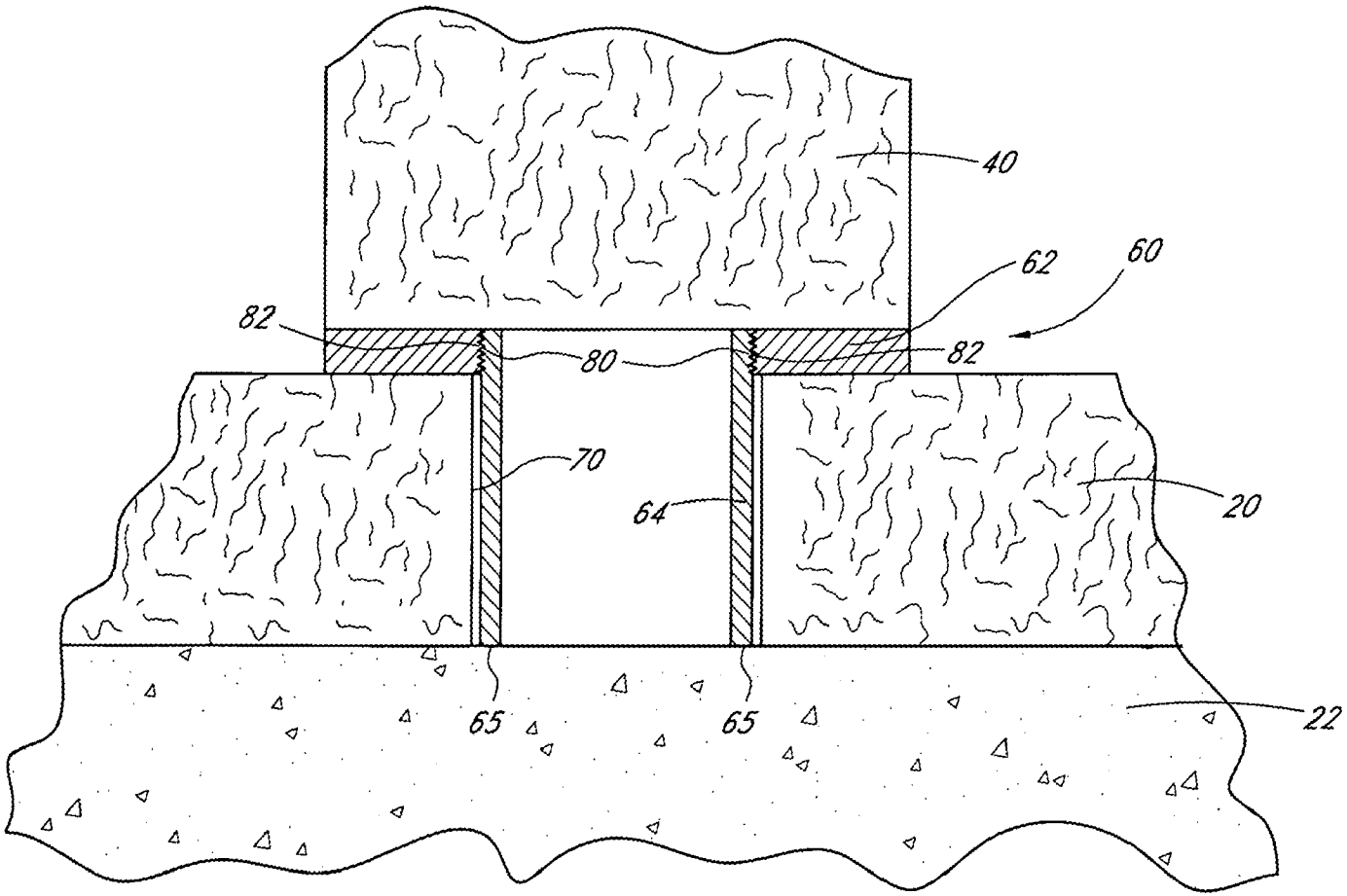
FIG. 8 illustrates a cross-sectional elevational view of an alternative embodiment of the compression post in which the extended portion is threaded into a threaded bore formed in the plate.

In another alternative embodiment illustrated in FIG. 8, an outer perimeter of a portion of the upper end of the cylinder 64 has threads 80 formed thereon. A threaded bore 82 is formed through the plate 62 to receive the threads 80 of the cylinder 64 to secure the cylinder 64 to the plate 62.

One skilled in art will appreciate that the foregoing embodiments and alternatives thereto are illustrative of the present invention. The present invention can be advantageously incorporated into alternative embodiments while remaining within the spirit and scope of the present invention, as defined by the appended claims.

We claim:

1. A method of reducing the lateral movement of a shear wall during a seismic event or a wind event, the method comprising:

constructing a shear wall having a plurality of studs, a first vertical end post and a second vertical end post mounted between a mudsill and a double top plate, each end post having a respective horizontal lower end positioned parallel to a top surface of the mudsill;

forming at least one hole in the mudsill proximate each end of the shear wall;

mounting a first compression post below the respective lower end of the first end post so that an extended portion of, the first compression post extends in a direction perpendicular to the lower end of the first end post;

mounting a second compression post below the respective lower end of the second post so that an extended portion of, the second compression post extends in a direction perpendicular to the lower end of the second end post;

positioning the extended portion of each compression post through the at least one hole in the mudsill at an end of the shear wall; and positioning the shear wall on a structural support with respective exposed ends of the extended portions of the compression posts resting on the support such that compressive forces applied to the end posts are communicated to the support via the compression posts rather than via the mudsill.

2. The method as defined in claim 1, wherein constructing the shear wall comprises mounting a structural sheet to the mudsill, the double top plate, the studs, the first end post and the second end post.

3. The method as defined in claim 1, wherein each compression post comprises a plate mounted to the respective lower end of the respective end post, and wherein the method comprises:

selecting dimensions of the plate to conform to the lower end of the respective end post;

positioning the respective extended portion of each compression post perpendicularly to the respective plate of each compression post;

selecting at least one dimension of the extended portion of each compression post to fit through the at least one hole formed in the mudsill proximate the respective end of the shear wall; and selecting a length of the extended portion to conform to a thickness of the mudsill such that when the shear wall is mounted on the structural support, compressive forces applied to each end post are communicated via the respective plate and the respective extended portion to the structural support.

4. The method as defined in claim 3, further comprising securing the extended portion of each compression post to the plate of the respective compression post.

5. The method as defined in claim 3, further comprising securing the extended portion of each compression post to the plate of the respective compression post by at least one weld.

6. The method as defined in claim 3, further comprising securing the extended portion of each compression post to the plate of the respective compression post by press fitting an end of the extended portion into a recess in the plate.

7. The method as defined in claim 3, further comprising:

threading one end of the respective extended portion of each compression post;

forming a threaded bore in the respective plate of each compression post; and engaging the threaded end of the extended portion of the compression post with the threaded bore of the plate to secure the extended portion to the plate.

8. The method as defined in claim 3, wherein the extended portion of each compression post includes an endcap on at least one end, and wherein the method further comprises:

forming a bore through the respective endcap of each compression post;

forming a threaded bore in the respective plate of each compression post; and extending a threaded bolt through the bore of the respective endcap of each compression post, and engaging the bolt with the threaded bore in the respective plate of each compression post to secure the extended portion to the plate.

9. The method as defined in claim 3, further comprising forming the extended portion of the compression post and the plate of the compression post as a cast unitary body.

10. The method as defined in claim 3, wherein the extended portion of the compression post is cylindrical and the at least one dimension of the extended portion is an outside diameter.

* * * * *